US005868611A

United States Patent [19]

Friel

[11] Patent Number: 5,868,611

[45] Date of Patent: Feb. 9, 1999

[54] VERSATILE MANUAL SHARPENER

[75] Inventor: Daniel D. Friel, Greenville, Del.

[73] Assignee: Edgecraft Corp., Avondale, Pa.

[21] Appl. No.: 889,768

[22] Filed: Jul. 8, 1997

Related U.S. Application Data

[60] Provisional application No. 60/021,385 Jul. 9, 1996.

[51] Int. Cl. [6] ..... B24B 25/00

[52] U.S. Cl. ..... 451/461; 451/523; 451/524

[58] Field of Search ..... 451/461, 45, 523, 451/524, 555, 349, 552, 558, 164, 282, 557, 293, 312, 65, 553, 556; 83/698.21; 30/125

[56] References Cited

U.S. PATENT DOCUMENTS

| | | | |
|---|---|---|---|
| 2,749,678 | 6/1956 | Jahn | 451/461 |
| 4,759,153 | 7/1988 | Cohen | 451/461 |
| 5,001,796 | 3/1991 | Desjardins | 30/125 |
| 5,046,385 | 9/1991 | Cozzini et al. | 451/461 |
| 5,404,679 | 4/1995 | Friel | 451/312 |
| 5,449,315 | 9/1995 | Friel | 451/282 |
| 5,582,535 | 12/1996 | Friel | 451/349 |
| 5,643,059 | 7/1997 | Chen | 451/45 |

*Primary Examiner*—Timothy V. Eley
*Assistant Examiner*—Derris H. Banks
*Attorney, Agent, or Firm*—Connolly & Hutz

[57] ABSTRACT

A versatile manual sharpener includes a primary sharpening section with an integral handle-like extension. An additional sharpening element is mounted to the handle-like extension in a manner to provide additional sharpening capability.

19 Claims, 3 Drawing Sheets

VERSATILE MANUAL SHARPENER

CROSS-REFERENCE TO RELATED APPLICATION

This application is based upon provisional application Ser. No. 60/021,385, filed Jul. 9, 1996.

BACKGROUND OF INVENTION

The present invention relates to variations of techniques described in application Ser. No. 08/431497, filed Apr. 28, 1995 and Ser. No. 08/466,451, filed Jun. 6, 1995 and its parent applications Ser. No. 08/391,250, filed Feb. 21, 1995, Ser. No. 08/055,856, filed Apr. 30, 1993, now U.S. Pat. No. 5,390,431 and Ser. No. 07/901,213, filed Jun. 18, 1992, now U.S. Pat. No. 5,404,679. All of the details of these applications and patents are incorporated herein by reference thereto.

U.S. application Ser. No. 08/466,451 and U.S. Pat. No. 5,390,431 describe unique manual sharpeners that utilize several constructions of interdigitating abrasive elements to produce very sharp edges quickly and reliably. Precision rigid angular guides are used to insure that the object being sharpened—such as a knife—is held at precisely the same angle stroke after stroke relative to the interdigitating abrasive elements. The blade is positioned by the guide at an angle so that the center line of the blade is approximately coincident with the line that bisects the vertex of the angle formed by the interdigitating pads. As a result, both sides of the edge are sharpened simultaneously.

The guides described in the earlier applications can be either roller type guides or rigid guides against which the knife blade is precisely positioned during the sharpening strokes. A manual sharpener of this type is described and illustrated in those prior disclosures with a handle that can be used to steady the sharpening section while the blade is being sharpened. The handle is of assistance to secure the sharpener against a rigid surface and to minimize the opportunity for it to move during the sharpening process.

The sharpeners described in the earlier applications and patents may have one or more primary sharpening stages such as described and commonly have two primary stages—a sharpening stage and a honing stage.

SUMMARY OF THE INVENTION

An object of this invention is to provide improvements to the sharpeners described in the earlier applications and patent. The usefulness and utility of those sharpeners can be substantially enhanced by providing additional sharpening elements and/or ultra honing elements in unique configurations on the handle of these sharpeners. These additional sharpening (or honing) means can be permanently affixed to the handle or preferably be held thereon by a means that allows these to be removed—for example by a magnet or a strip of magnetized material. The added sharpening elements when not affixed to the handle can be stored in a compartment within the handle of the sharpener. That compartment can have a closure such as a hatch cover to retain the removable sharpening elements when not in use. This creates a compact portable sharpener that has universal application, especially in field use.

For example, the additional sharpening means can be a coarse presharpening abrasive pad that is useful to create a crude edge on a knife prior to its sharpening and honing in the primary more precise sharpening and honing sections which sections may, for example, be constructed as described in the above mentioned applications and patents. The advantage of such a coarse presharpening pad is that it can quickly remove major nicks and quickly prepare a comparatively crude edge on a blade that will then sharpen quicker in the primary precision sharpening and honing sections. By adding this additional sharpening element the sharpener becomes a three-stage sharpener namely presharpening, sharpening, and honing.

The utility of such a unique sharpener can be further enhanced by adding an additional unique ultra honing element to create an "ultrasharp" edge on the blade after it has been sharpened with the primary precision sharpening and honing stages described in the aforementioned applications and patent. It has been found that a honing pad made of the compositions described in application Ser. No. 08/431,497, can be used to produce an "ultrasharp" edge on a blade after it has been sharpened and honed in the primary sharpening means as described in the aforementioned applications and patent. The flexibility and gentle abrading action of this type pad allows a further manual refinement of the edge without the need for ultraprecise control of the sharpening angle. Hence, by merely manually stroking the already quite sharp edge over this type of honing pad, alternating with light strokes first on one side of the edge then the other, an "ultrasharp" edge is created. Hence the combination of an additional coarse presharpening abrasive pad as described above and the two stage primary precision sharpening and honing stages as described in the aforementioned applications and patents, with the additional secondary honing pad creates a four stage sharpener. with this unique combination of the primary sharpening means with these added sharpening elements, one can create consistently "ultrasharp" edges even under adverse field conditions.

The added sharpening elements such as the coarse pads and honing pads described above can be permanently secured to the handle or preferably be held in place with a mechanical means or a magnetic means attached to the handle so that the sharpening elements can be readily put in place removed, or interchanged. A convenient storage compartment can be incorporated in the handle of the primary sharpening means with a hatch type cover that can be used to store an assortment of additional sharpening or honing pads of the type described herein.

THE DRAWINGS

DETAILED DESCRIPTION

Figure 3:
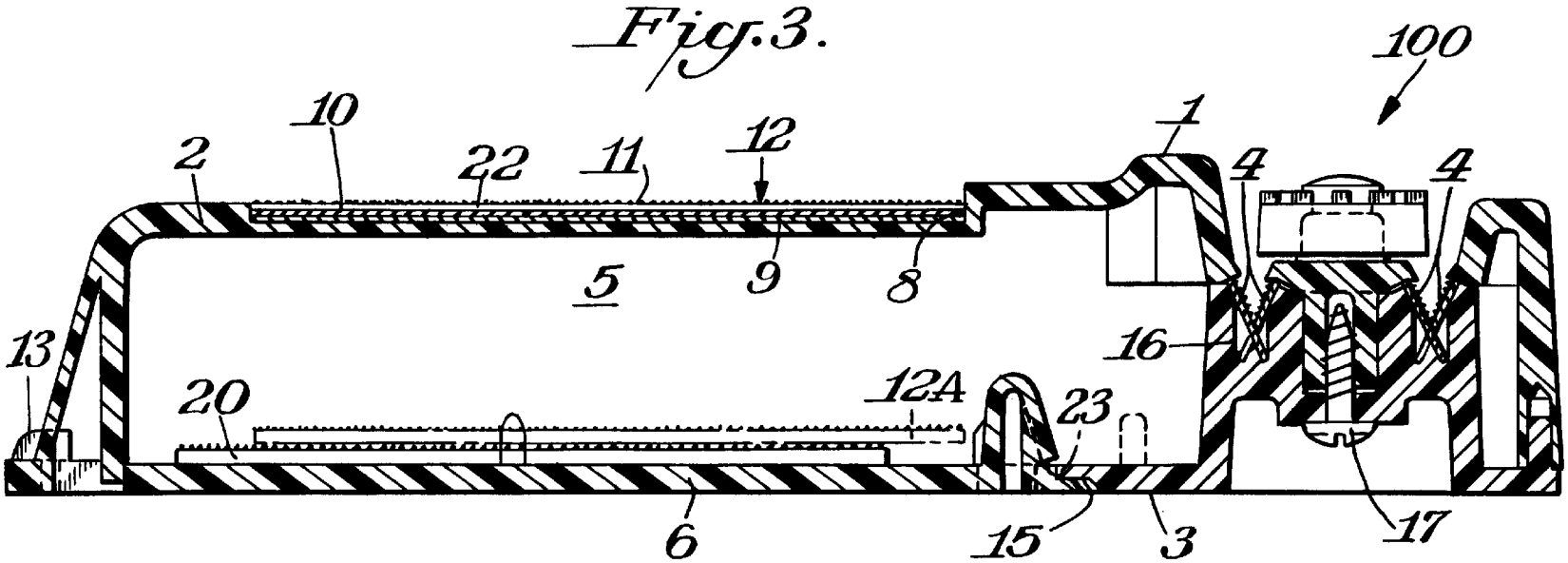
FIG. 3 is a cross-sectional view taken through FIG. 2 along the line 3—3.

FIG. 3 is a sectional view of a sharpener 100 incorporating the elements of this new sharpener. Sharpener 100 is constructed as a housing with an upper cover 1 which incorporates the handle portion 2 to the left. A base unit 3 inserts within the cover 1. Interdigitating pads 4 for the primary sharpening are supported as shown in FIG. 3 by cavities 16 provided in the base unit 3. The cover 1 clamps down to the base by means of screw 17 helping to secure the interdigitating pads 4 in place. Commonly one pair of pads 4 shown in FIG. 3 is set at an included angle of say 40° or 45° and the second pair 4 is positioned at a slightly larger included angle of, for example, 45° to 50°. The first pair will generally have a larger grit size than the second pair. Diamonds are the preferred abrasive, but other abrasive materials can be used. The cover 1 is constructed to form a compartment 5 within the handle 2. That compartment 5 can be enclosed on the underside of the handle by incorporating a hatch cover 6 that inserts into the left end of the handle and includes any suitable latching mechanism 7 to secure the hatch cover 6 into place. Cover 6 is designed so that the latching mechanism 7 can be readily released thereby opening the hatch cover 6 and providing ready access to the storage compartment 5. This creates a unique place to store additional sharpening elements when not in use.

The cover 1 of FIG. 3 is constructed with a recess 8 to receive the position additional sharpening and honing elements such a rectangular pad 12. Adhered to the bottom of the recess 8 is a strip of magnetized material 9 that will provide sufficient magnetic attraction for a ferromagnetic plate 10 of FIG. 3 that serves as a backing for the abrasive surface 11 to hold the abrasive coated pad 12 (or 12A) in place. One magnetized strip used successfully is marketed as Ultramag as supplied by Flexmag Industries of Cincinnati, Ohio 45242.

Figure 1:
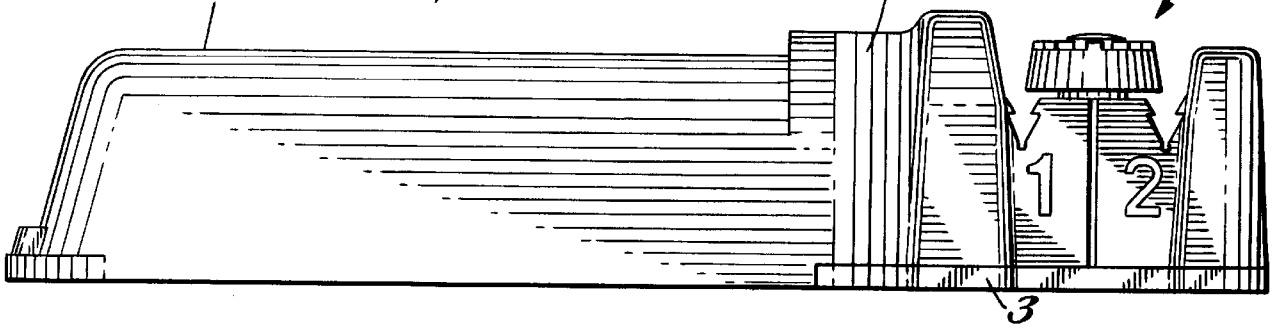
FIG. 1 is a side elevational view of a versatile manual sharpener in accordance with this invention.
Figure 5:
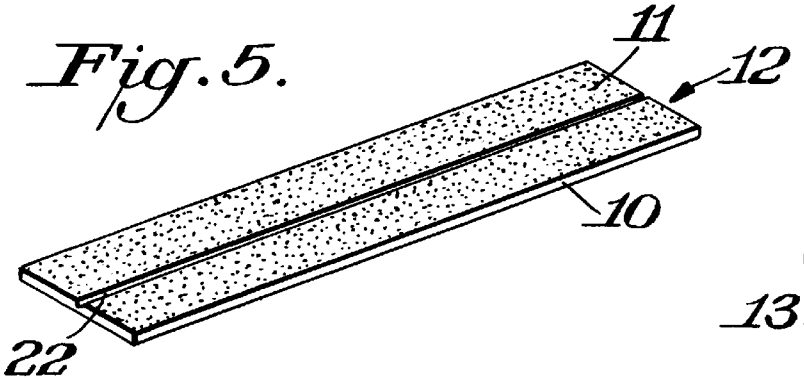
FIG. 5 is a perspective view of fish hook pad with intermediate grit used in the sharpener of FIGS. 1–3.
Figure 5A:
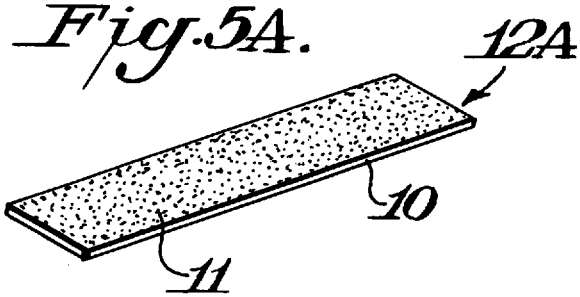
FIG. 5A is a view similar to FIG. 5 of a coarse pad.

FIG. 5A illustrates a coarse pad 12A which is in the form of a ferromagnetic plate 10 having an abrasive surface 11 wherein the abrasive particles are of coarse grit. When a coarse abrasive pad is in place in the recess and held there by the force of the magnet or by other means, it can be used to presharpen the edge by manually stroking the knife edge facet across that pad at an angle approximating the half angle of the precision sharpening stage, Stage 1 (FIG. 1), that uses the interdigitating pads commonly set at a total angle of 40° to 45°. While the manual control of angle may be poor, nicks can be removed along the edge quickly. If the angle is held relative to the abrasive surface at somewhat less than the half angle of Stage 1, metal will be removed from the shoulder just above the facet forming the edge, thereby speeding the sharpening process in Stage 1.

Ideally the ultra honing pad 20 would be used following the primary honing process in Stage 2 (FIG. 1) where the interdigitating pads are commonly set at a total angle of 45° to 50°. The ultrahoning pad 20 would be removed from compartment 5 and would be inserted into recess 8, with coarse pad 12A being stored in compartment 5. The knife edge facet should be presented to the surface of the honing pad at an angle similar to or slightly larger than the half angle of 22½° to 25°; however, because the ultra honing pad 20 is resilient and the abrasive action thereof is mild, the sharpening angle can deviate substantially from the ideal half angle without seriously affecting the fine quality of the final honed edge. An extremely sharp edge is thus created.

The coarse pad 12A, the two interdigitating stages 44, with excellent angle control, and the ultra hone pad 20 constitutes a unique four stage means of sharpening that generates an ultra-sharp edge.

It was found that this unique sharpener configuration surprisingly can be used for other purposes. For example, an abrasive coated pad 12 (with intermediate grit) constructed with a linear abrasive coated groove 22 on its surface, when placed in the recess on the handle, makes a particularly effective sharpener for fish hooks. FIG. 5 illustrates such a fish hook pad 12.

Further, it was found that with an abrasive pad in the handle recess, that pad can be conveniently used for sharpening hatchets, axes, hoes and other large edge tools. To use this new sharpener in this manner, it can be comfortably held by the other end, i.e. the end with the primary sharpening means with precise angle control and interdigitating pads.

The storage compartment 5 built into the sharpener is very convenient for the secure and clean storage of sharpening pads 12, 12A, 20 when not in use. Thus, compartment 5 can conveniently store various types of sharpening pads, such as a honing pad, an intermediate grid fishhook pad and a coarse pad. The pads when in use are mounted in the recess of the handle with the abrasive surface sufficiently above the surface of the handle to insure contact of the abrasive with the knife or other tool when being sharpened. Some of the sharpening debris, called swarf, may remain on the pad after sharpening. If the pad were permanently affixed to the handle, that debris can be transferred to the hand, soiling it during operations where the handle is used strictly for that purpose. Consequently there is an important advantage in using a magnetic system to hold the pads since the soiled pads can be removed, cleaned if desired, and stored—when not in use—in the compartment provided for that purpose. If the compartment 5 shown with hatch cover 6 is sufficiently large it can serve as a storage compartment for other items and purposes. Sharpener 100, thus makes a very versatile tool.

Figure 2:
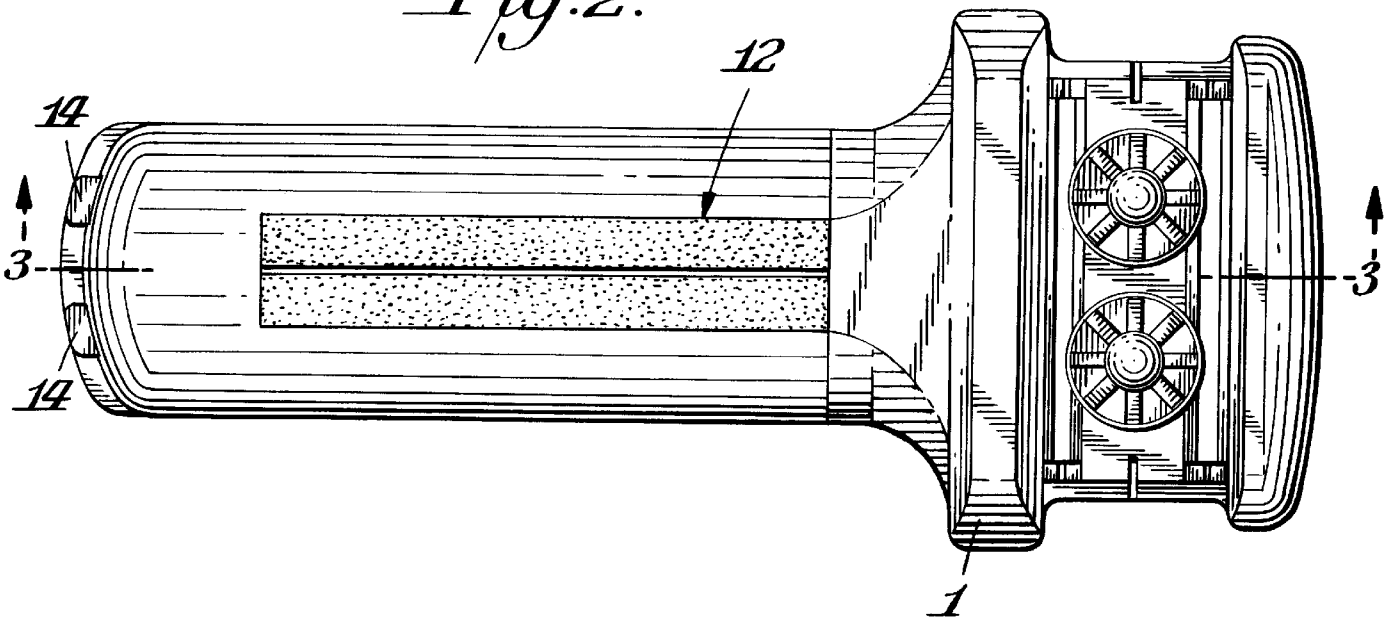
FIG. 2 is a top plan view of the sharpener shown in FIG. 1.
Figure 6:
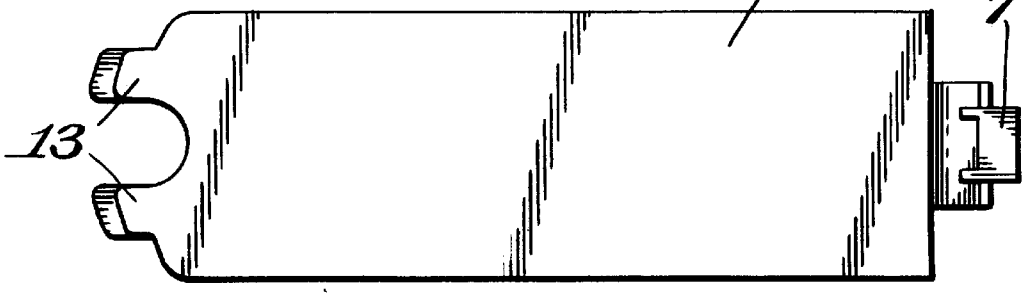
FIG. 6 is a bottom plan view of a hatch cover used in the sharpener of FIGS. 1–3.
Figure 4:
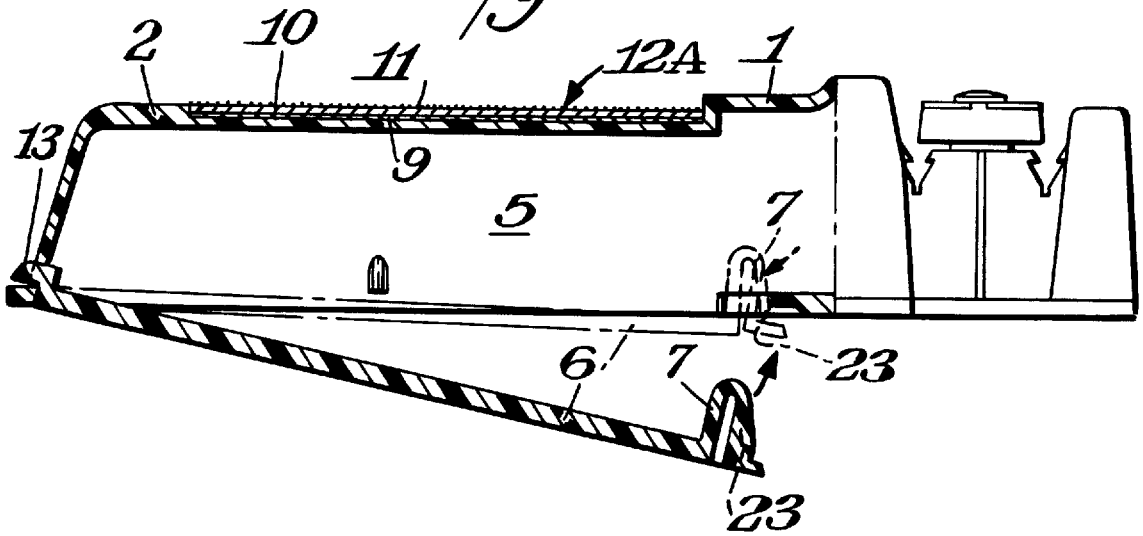
FIG. 4 is a view similar to FIG. 3, partially in section, and showing the hatch cover partially open.

As shown in FIGS. 3 and 4 the compartment 5 is constructed within the handle 2 which is part of the cover 1. A hatch cover 6 is provided for the compartment 5. One configuration of a hatch cover is shown in greater detail in FIG. 6. This is constructed with toe like extensions 13 which insert into corresponding slots 14 (FIG. 2) in the end of the handle 2 creating a hinging action or pivot line about which the hatch cover 6 rotates. The latch 7 mates with an accepting slotting arrangement 15 that is formed as part of the base 3. The latch 7 includes a resilient wall 23 that passes through the slotting arrangement 15 to lock the hatch cover 6 in place. FIG. 4, for example, shows the hatch cover 6 as the locking is about to take place. The latch snaps closed as it conforms with the slotting arrangement 15. The latch 7 can be released by moving its spring-like extensions to the left to release wall 23 and the hatch cover 6 then can be opened by swinging the hatch cover 6 out in an arc around the line of the toes 13 in a direction opposite to the arrow in FIG. 4. The hatch can then be removed completely if one wishes.

The additional sharpening elements can, for example, be rectangular pads about ½×2 inches long and about 1/16 to ¼" thick. If these are held in place with a magnet they must contain a ferromagnetic material and preferably the abrasive material is adhered to a ferromagnetic plate. Diamonds, the preferred abrasive because of its efficiency and speed can be bound to the plate with electroplated nickel. Ultrahoning materials such as described in application Ser. No. 08/431,497 can be adhered in layer form on such ferromagnetic plates. These can be made with an epoxy matrix containing aluminum oxide as described in that application or with similar combinations of matrix and abrasives. Alternatively the honing pad may be made of a polymer olefinic thermoplastic resin system based on an ethylene copolymer containing by weight 50–80% abrasive particles, with the abrasive particles being 1 to 25 microns in diameter.

What is claimed is:

1. A versatile manual sharpener comprising a primary sharpening section having primary sharpening members therein, a handle-like extension integral with said sharpening section for holding or stabilizing said sharpening section, attachment structure on said extension, a sharpening element secured to said attachment structure and exposed on a surface of said extension for providing sharpening capability in addition to said primary sharpening members said attachment structure being a magnetic structure, and said sharpening element having a ferromagnetic plate held in position by said magnetic structure.

2. A sharpener according to claim 1 where said primary sharpening section includes at least one sharpening stage incorporating interdigitating abrasive elements as said sharpening members.

3. A sharpener according to claim 1 where said handle-like extension contains a storage compartment for holding at least one further sharpening element.

4. A versatile manual sharpener comprising a primary sharpening section having primary sharpening members therein, a handle-like extension integral with said sharpening section for holding or stabilizing said sharpening section, attachment structure on said extension, a sharpening element secured to said attachment structure and exposed on a surface of said extension for providing sharpening capability in addition to said primary sharpening members, and said primary sharpening section including at least one sharpening stage incorporating interdigitating abrasive elements as said sharpening members.

5. A versatile manual sharpener comprising a primary sharpening section having primary sharpening members therein, a handle-like extension integral with said sharpening section for holding or stabilizing said sharpening section, attachment structure on said extension, a sharpening element secured to said attachment structure and exposed on a surface of said extension for providing sharpening capability in addition to said primary sharpening members, and said handle-like extension containing a storage compartment for holding at least one further sharpening element.

6. A versatile manual sharpener comprising a primary sharpening section having primary sharpening members therein, a handle-like extension integral with said sharpening section for holding or stabilizing said sharpening section, attachment structure on said extension, a sharpening element secured to said attachment structure and exposed on a surface of said extension for providing sharpening capability in addition to said primary sharpening members, and said sharpening element being a pad with an abrasive coated groove approximately V shaped, on the order of 0.005 to 0.025 inch deep and on the order of 0.010 to 0.050 inch wide at its opening.

7. A versatile manual sharpener comprising a primary sharpening section having primary sharpening members therein, a handle-like extension integral with said sharpening section for holding or stabilizing said sharpening section, attachment structure on said extension, a sharpening element secured to said attachment structure and exposed on a surface of said extension for providing sharpening capability in addition to said primary sharpening members, and said sharpening element being a sharpening pad with a planar surface coated with an abrasive material.

8. A versatile manual sharpener comprising a primary sharpening section having primary sharpening members therein, a handle-like extension integral with said sharpening section for holding or stabilizing said sharpening section, attachment structure on said extension, a sharpening element secured to said attachment structure and exposed on a surface of said extension for providing sharpening capability in addition to said primary sharpening members, said sharpening element being an elongated pad having an abrasive coated upper surface, and a longitudinal abrasive coated groove in said upper surface.

9. A versatile manual sharpener comprising a primary sharpening section having primary sharpening members therein, a handle-like extension integral with said sharpening section for holding or stabilizing said sharpening section, attachment structure on said extension, a sharpening element secured to said attachment structure and exposed on a surface of said extension for providing sharpening capability in addition to said primary sharpening members, and said sharpening element being detachably secured to said attachment structure to permit replacement by a further sharpening element.

10. A sharpener according to claim 9 where said handle contains a storage compartment.

11. A sharpener according to claim 10 where said sharpening element is a first sharpening element, a further sharpening element being stored in said compartment, and one of said sharpening elements being a coarse abrasive pad with the other of said sharpening elements being a honing pad.

12. A sharpener according to claim 11 where said primary sharpening section contains two sharpening stages with primary sharpening members of different characteristics.

13. A sharpener according to claim 12 where each of said sharpening stages has two primary sharpening members in the form of interdigitating abrasive elements.

14. A sharpener according to claim 13 where said attachment structure is a magnetic structure, and each of said coarse abrasive pad and said honing pad includes a ferromagnetic plate.

15. A sharpener according to claim 11 where said attachment structure is a magnetic structure, and each of said coarse abrasive pad and said honing pad includes a ferromagnetic plate.

16. A versatile manual sharpener having a primary sharpening section, at least one primary sharpening member in said primary sharpening section, a secondary sharpening section mounted to said primary sharpening section, a secondary sharpening element in said secondary sharpening section, said secondary sharpening element being an elongated pad in the form of a plate having an abrasive coated upper surface, and a longitudinal abrasive coated groove in said upper surface.

17. A sharpener according to claim 16 wherein said secondary sharpening section includes magnetic structure, and said plate being a ferromagnetic plate detachably secured to said magnetic structure.

18. A sharpener according to claim 17 wherein said secondary sharpening section includes a storage compartment for holding at least one further sharpening element.

19. A sharpener according to claim 16 wherein said secondary sharpening section includes a storage compartment for holding at least one further sharpening element.

* * * * *